US010971862B2

(12) United States Patent
Naganuma et al.

(10) Patent No.: US 10,971,862 B2
(45) Date of Patent: Apr. 6, 2021

(54) CABLE CONNECTOR HAVING CRIMP STRUCTURE

(71) Applicant: HIROSE ELECTRIC CO., LTD., Tokyo (JP)

(72) Inventors: Kenichi Naganuma, Tokyo (JP); Tadashi Sakaizawa, Tokyo (JP); Yusuke Sakoda, Tokyo (JP); Shingo Chamura, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/626,548

(22) PCT Filed: May 25, 2018

(86) PCT No.: PCT/JP2018/020108
§ 371 (c)(1),
(2) Date: Dec. 25, 2019

(87) PCT Pub. No.: WO2019/012816
PCT Pub. Date: Jan. 17, 2019

(65) Prior Publication Data

US 2020/0287330 A1 Sep. 10, 2020

(30) Foreign Application Priority Data

Jul. 12, 2017 (JP) ..... JP2017-135891

(51) Int. Cl.
*H01R 13/6581* (2011.01)
*H01R 4/18* (2006.01)

(52) U.S. Cl.
CPC ..... *H01R 13/6581* (2013.01); *H01R 4/18* (2013.01)

(58) Field of Classification Search
CPC ..... H01R 4/18; H01R 13/6581
See application file for complete search history.

(56) References Cited

U.S. PATENT DOCUMENTS 4,917,629 A 4/1990 Matsuzaki
5,518,421 A 5/1996 Davis
(Continued)

FOREIGN PATENT DOCUMENTS

JP H1315968 A 12/1989
JP 2502459 Y2 6/1996
(Continued)

OTHER PUBLICATIONS

International Search Report dated Jul. 31, 2018 filed in PCT/JP2018/020108.
(Continued)

*Primary Examiner* — Briggitte R. Hammond
(74) *Attorney, Agent, or Firm* — Rankin, Hill & Clark LLP

(57) ABSTRACT

When a swaging portion (71) of one shell (60) is swaged to a cable (5), even in a case where a main body (42) of the other shell (40) receives tensile force through a sandwiching portion (43) sandwiched between the swaging portion (71) and the cable (5), the risk of pulling the main body (42) of the other shell itself is reduced, and deformation and damage of the other shell (40) are prevented. A cable connector includes a housing (20) configured to hold one end of a cable (5) and a first shell (60) and a second shell (40) including main bodies covering at least a portion of the housing (20). The first shell (60) has a swaging portion (71) to be swaged to the cable (50). The second shell (40) has a sandwiching portion (43) to be swaged together with the cable by the swaging portion (71) with the sandwiching portion being sandwiched between the swaging portion (71) and the cable. The sandwiching portion (43) and the main body (42) of the second shell are connected to each other through an extendable extra length portion (47) at least in an axial direction.

13 Claims, 6 Drawing Sheets

(56) References Cited

U.S. PATENT DOCUMENTS

| | | | | |
|---|---|---|---|---|
| 5,725,395 | A * | 3/1998 | Lee | H01R 13/504 439/108 |
| 10,381,785 | B2 | 8/2019 | Maesoba et al. | |
| 2018/0351305 | A1 | 12/2018 | Maesoba et al. | |

FOREIGN PATENT DOCUMENTS

| | | | |
|---|---|---|---|
| JP | 3354269 | B2 | 12/2002 |
| JP | 2010176960 | A | 8/2010 |
| JP | 2017-98079 | A | 6/2017 |

OTHER PUBLICATIONS

Chinese Office Action (CNOA) dated Dec. 28, 2020 issued in corresponding Chinese Patent Application No. 201880045968.2.

* cited by examiner

CABLE CONNECTOR HAVING CRIMP STRUCTURE

TECHNICAL FIELD

The present invention relates to a cable connector, and more specifically relates to a cable connector having a swaging structure.

BACKGROUND ART

At a high-speed transmission cable connector used for a mobile phone, a computer, a PDA and the like, a shell is provided to prevent noise. Patent Literature 1 (JP-A-2010-176960) describes one example of the cable connector provided with the shell. The cable connector includes a housing, two covers, i.e., two shells, covering at least a portion of the housing and formed from, e.g., metal plates, and a cable fixing portion.

The cable fixing portion can fix a cable between a receiving-side fixing portion and a holding-side fixing portion. The receiving-side fixing portion is provided at one shell, and the holding-side fixing portion is provided at the other shell.

At the receiving-side fixing portion provided at one shell, a cable receiving portion configured to receive a main body of the cable and a swaging portion configured to swage the main body of the cable are provided. The swaging portion is swaged in a state in which an external conductor of the cable arranged at the outer periphery of the cable is sandwiched between the swaging portion and the holding-side fixing portion. In other words, the holding-side fixing portion is, by the swaging portion, pressed toward the main body of the cable in the cable receiving portion. In this manner, the swaging portion and the holding-side fixing portion can be electrically connected to the external conductor of the cable, and the cable can be swaged.

CITATION LIST

Patent Literature

PATENT LITERATURE 1: JP-A-2010-176960

SUMMARY OF THE INVENTION

Problem to be Solved by the Invention

In the configuration of Patent Literature 1, when the swaging portion is swaged, the holding-side fixing portion is pressed toward the main body of the cable in the cable receiving portion, and receives tensile force on the side of the main body of the cable. As a result, the other shell, e.g., the main body thereof, also receives the tensile force through the holding-side fixing portion. Due to such tensile force, there is a probability that the other shell is deformed or damaged.

The invention of the present application has been made for solving such problems of the prior art, and an object of the invention of the present application is that when a swaging portion of one shell is swaged to a cable, even in a case where a main body of the other shell receives tensile force through a sandwiching portion sandwiched between the swaging portion and the cable, the risk of pulling the main body of the other shell itself is reduced and deformation and damage of the other shell are prevented.

Solution to the Problems

For solving the above-described problems, a cable connector according to one aspect of the present invention includes a housing configured to hold one end of a cable, a first shell having a main body covering at least a portion of the housing, and a second shell having a main body covering at least a portion of the housing. The first shell has, at a position apart from the main body of the first shell in an axial direction of the cable, a swaging portion to be swaged to the cable. The second shell has, at a position apart from the main body of the second shell in the axial direction of the cable, a sandwiching portion to be swaged together with the cable by the swaging portion with the sandwiching portion being sandwiched between the swaging portion and the cable. The sandwiching portion and the main body of the second shell are connected to each other through an extendable extra length portion at least in the axial direction.

According to the cable connector of this aspect, the extra length portion is provided. Thus, when the swaging portion is swaged to the cable, even in a case where the main body of the second shell receives tensile force through the sandwiching portion, the extra length portion is extended so that the risk of pulling the main body itself can be reduced and deformation and damage of the second shell can be effectively prevented.

In the cable connector of the above-described aspect, the sandwiching portion may be supported in a cantilever shape from the main body of the second shell toward the swaging portion of the first shell.

Moreover, in the cable connector of the above-described aspect, the extra length portion may have a bent portion, and the bent portion may at least include a portion extending in the axial direction and a portion extending in a radial direction of the cable.

With these portions, the extra length portion is extendable.

Further, in the cable connector of the above-described aspect, the bent portion may further include a portion extending in a circumferential direction of the cable.

With the portion extending in the circumferential direction, an extension direction of the extra length portion can be matched to the shape of the cable.

In addition, in the cable connector of the above-described aspect, the main body of the second shell may have a pair of side walls arranged to face each other, and the sandwiching portion may be connected to each of the pair of side walls through the extra length portion.

Moreover, in the cable connector of the above-described aspect, a step portion for narrowing a width between the pair of side walls facing each other may be provided at each side wall.

With the step portion, the sandwiching portion can be placed close to the swaging portion without an increase in the length of the extra length portion.

Further, in the cable connector of the above-described aspect, a slit is preferably provided in the vicinity of a base portion of the extra length portion at each side wall.

With the slit, the extra length portion can be smoothly extended.

In addition, in the cable connector of the above-described aspect, the swaging portion is, in the circumferential direction of the cable, preferably provided continuously to an inner surface of a cable receiving portion on which the cable is to be mounted, and at least a portion of the sandwiching portion is, in the circumferential direction, preferably arranged closer to the swaging portion with respect to a boundary between the cable receiving portion and the swaging portion.

According to the cable connector of this aspect, at least the portion of the sandwiching portion is directly swaged by the swaging portion, and therefore, the first shell and the second shell can be more firmly connected to each other through contact between the sandwiching portion and the swaging portion and physical and electrical connection between these shells can be reliably made.

Moreover, in the cable connector of the above-described aspect, at least some walls of the main body of the first shell are preferably positioned closer to the swaging portion than the base portion is to in the vicinity of the base portion of the extra length portion of the main body of the second shell, and a cutout for avoiding collision with the extra length portion is preferably provided near the base portion at the some walls.

With the cutout, collision of the second shell with the wall of the first shell in the vicinity of the base portion when the swaging portion is swaged to the cable can be prevented.

Further, in the cable connector of the above-described aspect, the swaging portion preferably has two swaging pieces each extending from both ends of the cable receiving portion in the circumferential direction, and at least a portion of the sandwiching portion is preferably swaged by the swaging portion at a portion other than a portion at which the two swaging pieces engage with each other.

Tendency shows that swaging force is weaker at the portion at which the swaging pieces engage with each other. For this reason, the sandwiching portion is swaged at the portion other than the engagement portion so that the first shell and the second shell can be more firmly connected to each other through contact between the sandwiching portion and the swaging portion and physical and electrical connection between these shells can be reliably made.

In the cable connector of the above-described aspect, the sandwiching portion preferably includes at least two sandwiching portions, and the sandwiching portions are preferably arranged substantially bilaterally symmetrically about the cable receiving portion in the section of the cable in the radial direction.

With the sandwiching portions provided at such positions, when the swaging portion is swaged to the cable, even in a case where the main body receives the tensile force through the sandwiching portions, the tensile force can be equally dispersed to the right and left.

Effects of the Invention

According to the cable connector of the invention of the present application, when the swaging portion of one shell is swaged to the cable, even in a case where the main body of the other shell receives the tensile force through the sandwiching portion sandwiched between the swaging portion and the cable, the risk of pulling the main body of the other shell itself can be reduced, and deformation and damage of the other shell can be prevented.

DESCRIPTION OF THE EMBODIMENTS

Hereinafter, a preferred embodiment of the present invention will be described with reference to the attached drawings. Hereinafter, only the preferred embodiment will be described, but needless to say, is not intended to limit the present invention.

Figure 1:
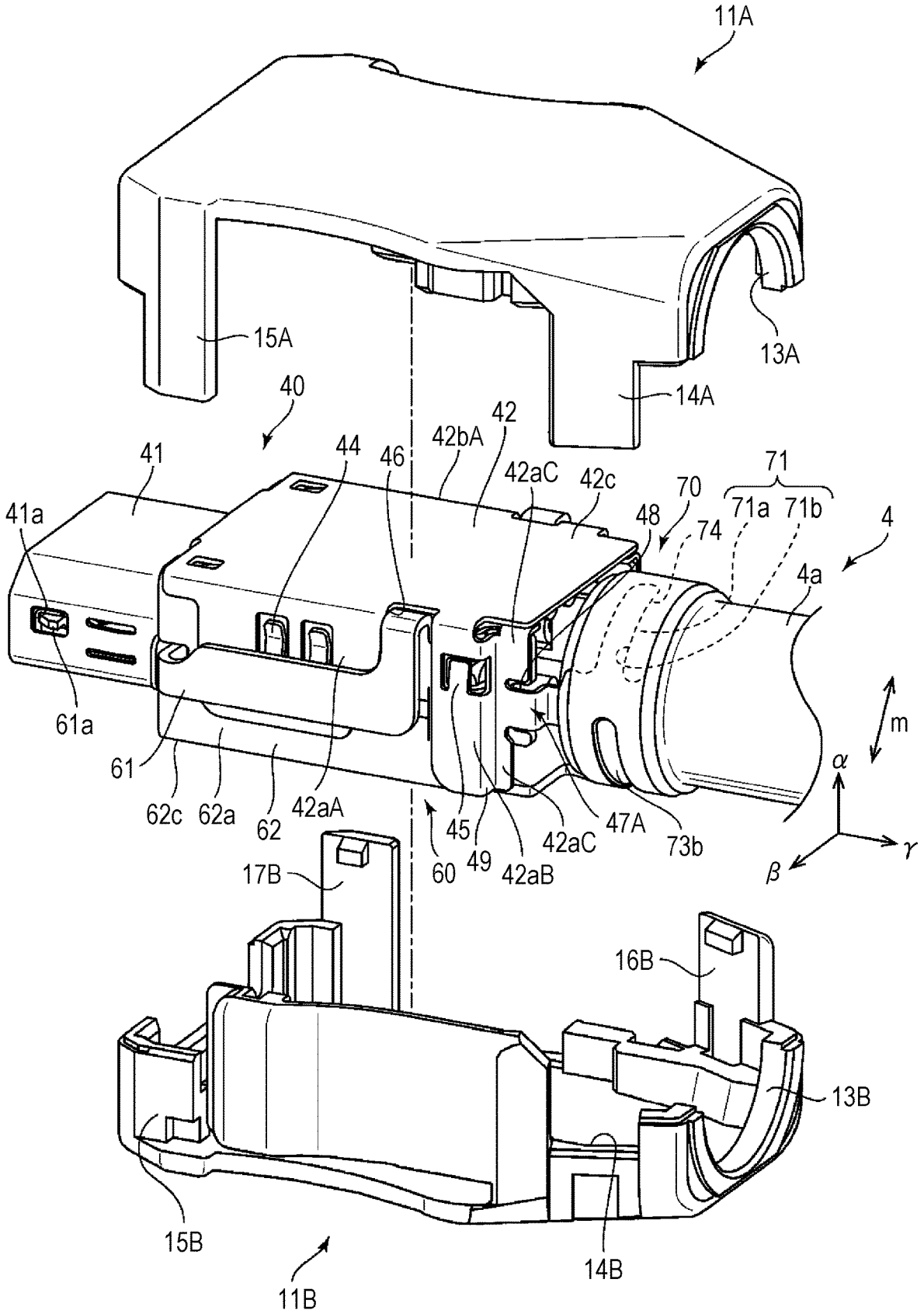
FIG. 1 is an exploded perspective view of a cable connector according to one embodiment of the present invention, FIG. 1 illustrating a state in which first and second covers are detached from the cable connector as a completed product.
Figure 2:
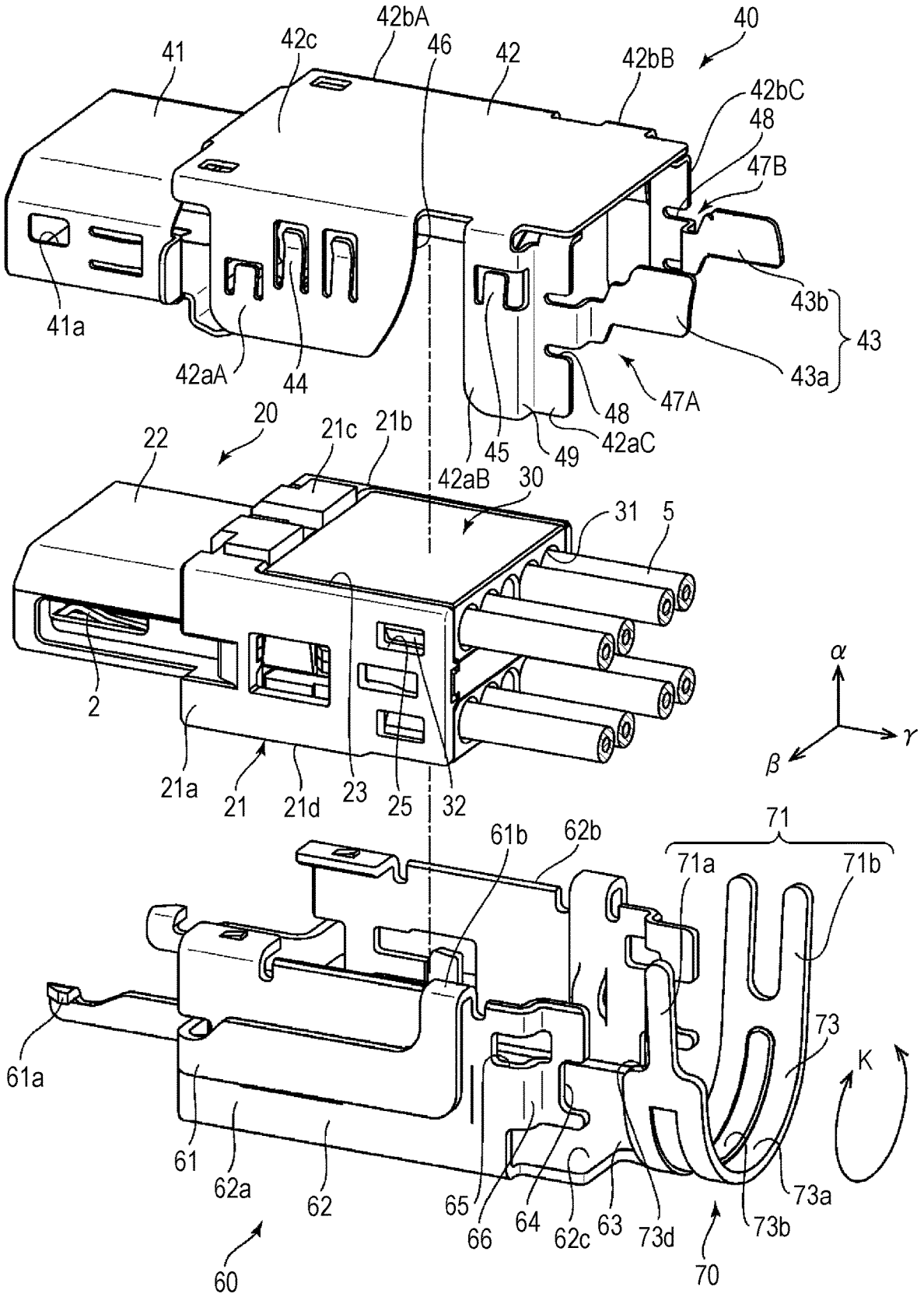
FIG. 2 is a view illustrating a state in which the first and second shells are further detached from the state of FIG. 1 to expose, e.g., a housing.

FIGS. 1 and 2 illustrate exploded perspective views of a cable connector according to one embodiment of the present invention. Specifically, FIG. 1 illustrates a state in which first and second covers 11A, 11B are detached from the cable connector as a completed product to expose first and second shells 60, 40, and FIG. 2 illustrates a state in which the first and second shells 60, 40 are further detached from the state of FIG. 1 to expose a housing 20 and to expose thin cables 5 embedded in a cable 4. Each of these figures illustrates the state before swaging of the cable connector.

The cable connector mainly includes the resin housing 20 configured to hold one end of the cable 4, more specifically one ends of eight thin cables 5 embedded in the cable 4, the metal first and second shells 60, 40 covering the outside of the housing 20, and the resin first and second covers 11A, 11B covering the outside of the first and second shells 60, 40.

Both of the first shell 60 and the second shell 40 are formed in such a manner that metal thin plates are punched and bent. The first shell 60 and the second shell 40 are assembled together to sandwich the housing 20 therebetween.

The second shell 40 mainly includes a main body 42, a substantially-tubular fitting raised portion 41 extending toward a front side of the main body 42, i.e., the side of fitting to a partner connector (not shown), and sandwiching portions 43*a*, 43*b* provided on a back side of the main body 42.

The fitting raised portion 41 is fitted in a predetermined portion of the partner connector upon fitting between the cable connector and the partner connector. By fitting, the cable connector is electrically connected to the partner connector. A portion 61*a* of the first shell 60 is exposed through a window 41*a* provided at a side surface of the fitting raised portion 41. The exposed portion 61*a* is a tip end portion of an elastic lock piece 61, and can be elastically locked at the predetermined portion of the partner connector when the fitting raised portion 41 is fitted in the predetermined portion of the partner connector.

The main body 42 mainly includes a pair of side walls 42*a* (42*a*A to 42*a*C), 42*b* (42*b*A to 42*b*C) arranged to face each other and an upper wall 42*c*. Each of the side walls 42*a*, 42*b* extends along an axial direction (the direction of an illustrated arrow "γ") of the cable 4, and is provided with a cutout 46 for taking out the elastic lock piece 61 of the first shell 60. Contact pieces 44 are provided at each of side wall portions 42*a*A, 42*b*A of the side walls 42*a*, 42*b* positioned on a front side of the cutout 46 in the axial direction "γ" of the cable 4. The contact piece 44 is used for enhancing electrical connection between the first shell 60 and the second shell 40 by conductive connection with a predetermined portion (side walls 62*a*, 62*b*) of the first shell 60. On the other hand, a locking piece 45 to be locked at a predetermined portion (a locking hole 65) of the first shell 60 is provided at each of side wall portions 42*a*B, 42*b*B of the side walls 42*a*, 42*b* positioned on a back side of the cutout 46 in the axial direction "γ" of the cable 4.

At side wall portions 42*a*C, 42*b*C positioned further on a back side of the locking piece 45, the pair of sandwiching portions 43*a*, 43*b* is positioned apart from the main body 42 in the axial direction "γ" of the cable 4. The sandwiching portions 43*a*, 43*b* are swaged with a predetermined portion (a cable fixing portion 70) of the first shell 60 together with the cable 4, more specifically an outer cover 4*a* of the cable 4 and an external conductor (a braid) inside the cable 4, for example. With these sandwiching portions 43*a*, 43*b*, mechanical connection between the first shell 60 and the second shell 40 can be more enhanced, and the first shell 60 can be electrically connected to the second shell 40 and the external conductor of the cable 4.

The first shell 60 mainly includes a main body 62, the elastic lock pieces 61 extending toward a front side of the main body 62, and the cable fixing portion 70 provided on a back side of the main body 62.

The main body 62 mainly includes the pair of side walls 62*a*, 62*b* and a bottom wall 62*c*. One end 61*b* of the elastic lock piece 61 is coupled to an upper edge of each of the pair of side walls 62*a*, 62*b*. The locking hole 65 in which the locking piece 45 of the second shell 40 is to be fitted is provided on a back side of the coupling portion 61*b*.

The cable fixing portion 70 includes a cable receiving portion 73 on which the cable 4 is to be mounted and a swaging portion 71 to be swaged to the cable 4.

The cable receiving portion 73 is in a substantially semicircular shape in a section "α-β" in a radial direction, and an inner surface 73*a* of the cable receiving portion 73 is in an arc shape in accordance with the outer surface shape of the cable 4. A portion 73*b* of the inner surface 73*a* of the cable receiving portion 73 protrudes inwardly, and is placed close to the cable 4 to swage the cable 4 with stronger force.

At a position apart from the main body 62 in the axial direction "γ" of the cable 4, the swaging portion 71 is provided with the swaging portion 71 being coupled to the main body 62 through a coupling portion 63. The swaging portion 71 includes swaging pieces 71*a*, 71*b* provided continuously to the inner surface 73*a* of the cable receiving portion 73 in a circumferential direction (the direction of an illustrated arrow "K") of the cable 4 and each extending from both ends in the circumferential direction "K." With these swaging pieces 71*a*, 71*b* and the cable receiving portion 73, the cable fixing portion 70 is in a substantially U-shape as illustrated in FIG. 2 before swaging of the swaging portion 71, and is in a substantially circular shape as illustrated in FIG. 1 after swaging.

The housing 20 mainly includes a main body 21 and a fitting protruding portion 22 extending toward a tip end of the main body 21.

The fitting protruding portion 22 is covered with the fitting raised portion 41 of the first shell 60. Multiple contacts 2 are arrayed inside the fitting protruding portion 22, and each contact 2 is connected to the thin cable 5 embedded in the cable 4. The thin cables 5 may be held by a terminal holding portion 30. One end side of each thin cable 5 is inserted into an insertion hole 31 provided at a back portion of the terminal holding portion 30 so that the thin cable 5 can be fixed to the terminal holding body 30. In this case, the terminal holding portion 30 forms a portion of the main body 21.

The main body 21 is provided with a housing space 23 in which the terminal holding portion 30 is to be housed, and is assembled with the terminal holding portion 30 housed in the housing space 23 to form a substantially rectangular shape as a whole. For fixing the terminal support body 30 to the main body 21, locking raised portions 32 are provided at the terminal support body 30, and locking holes 25 are provided corresponding to the locking raised portions 32 at the main body 21. Note that the terminal holding portion 30 is not necessarily provided, and the thin cables 5 may be directly supported on the main body 21 without the use of the terminal holding body 30.

When the first shell 60 and the second shell 40 are attached to the main body 21, side surfaces 21*a*, 21*b* of the main body 21 are covered with the side walls 62*a*, 62*b* of the main body 62 of the first shell 60, and these side walls 62*a*, 62*b* are further covered with the side walls 42*a* (42*a*A to 42*a*C), 42*b* (42*b*A to 42*b*C) of the main body 42 of the second shell 40. On the other hand, an upper portion 21*c* of the main body 21 is covered with the upper wall 42*c* of the main body 42 of the first shell 60, and a bottom portion 21*d* of the main body 21 is covered with the bottom wall 62*b* of the main body 62 of the first shell 60.

The peripheries of the first shell 60 and the second shell 40 are covered with the covers 11A, 11B, except for the fitting raised portion 41. Multiple installation legs 14A, 15A are provided at the cover 11A, and multiple installation recesses 14B, 15B are provided corresponding to the installation legs 14A, 15A at the cover 11B. Similarly, multiple installation legs 16B, 17B are provided at the cover 11B, and multiple installation recesses (not shown) are provided corresponding to the installation legs 16B, 17B at the cover 11A. Semicircular openings 13A, 13B through which the cable 4 is led out are each formed at back portions of the covers 11A, 11B. When the cover 11A and the cover 11B are assembled together, the openings 13A, 13B form a circular shape as in the section of the cable 4 in the radial direction.

A relationship among the swaging portion 71 provided at the first shell 60 and the sandwiching portions 43 provided at the second shell 40 will be described with reference to FIGS. 3 to 8.

Figure 3:
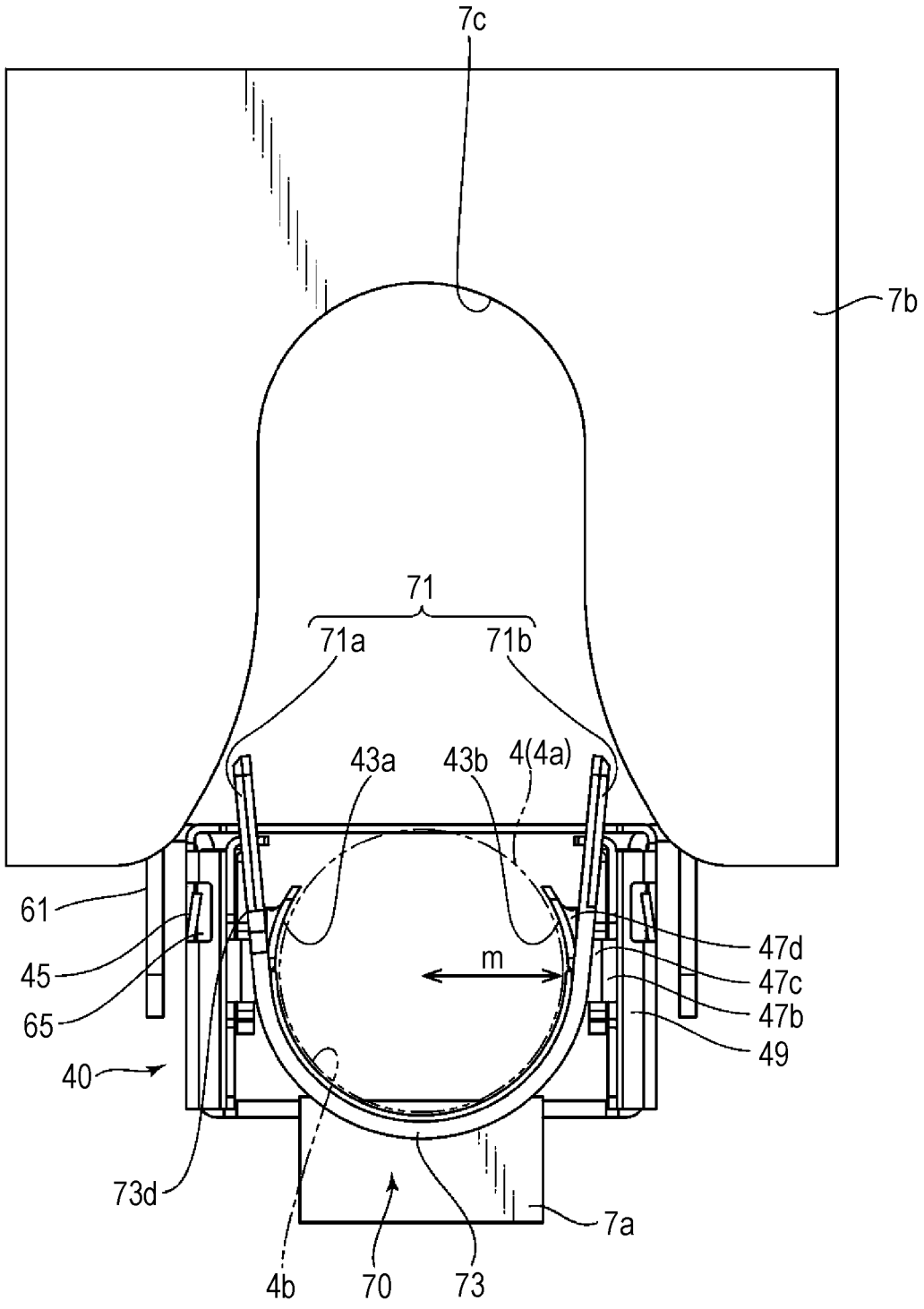
FIG. 3 is a schematic back view of jigs for swaging a swaging portion together with peripheral members of the swaging portion and sandwiching portions.
Figure 4:
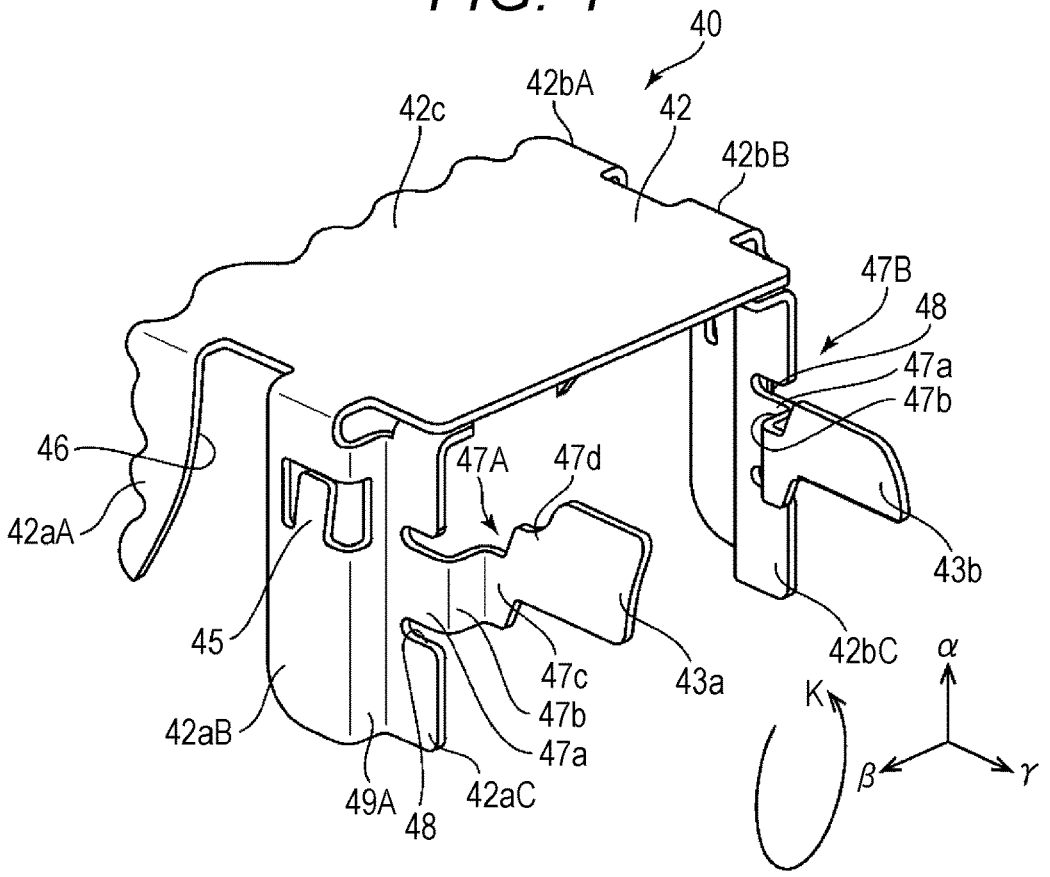
FIG. 4 is a partial enlarged view of the back of the second shell.
Figure 5:
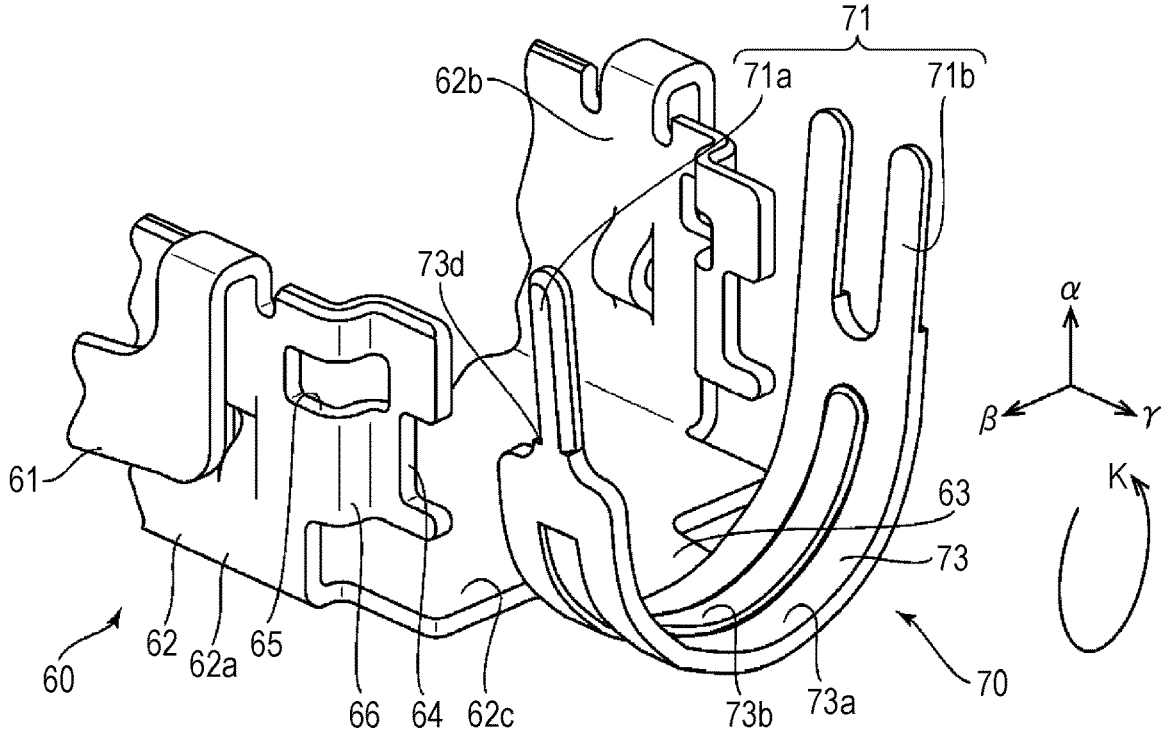
FIG. 5 is a partial enlarged perspective view of the back of the first shell.
Figure 6:
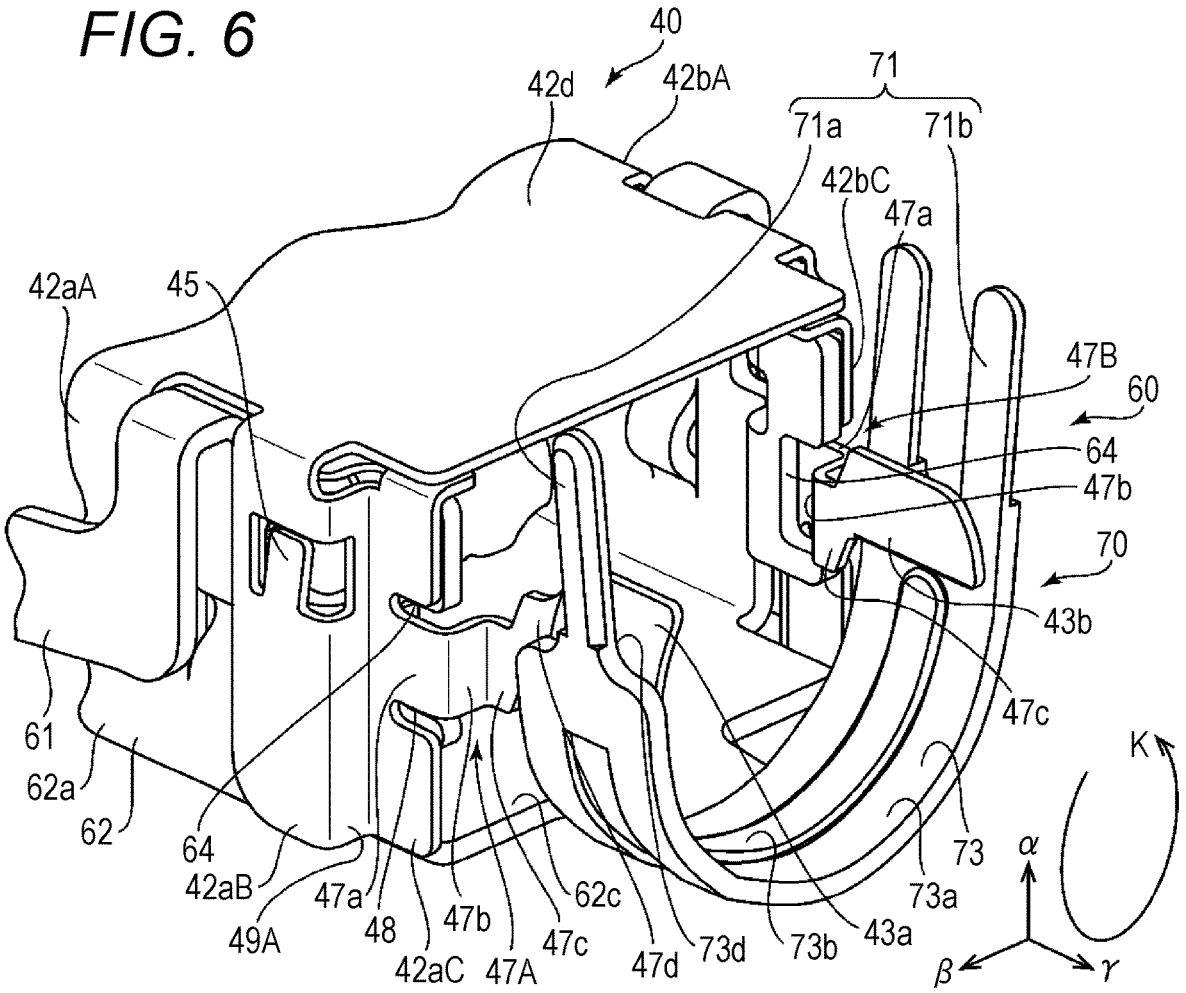
FIG. 6 is a partial enlarged perspective view illustrating a state in which the first shell and the second shell are assembled together.
Figure 7:
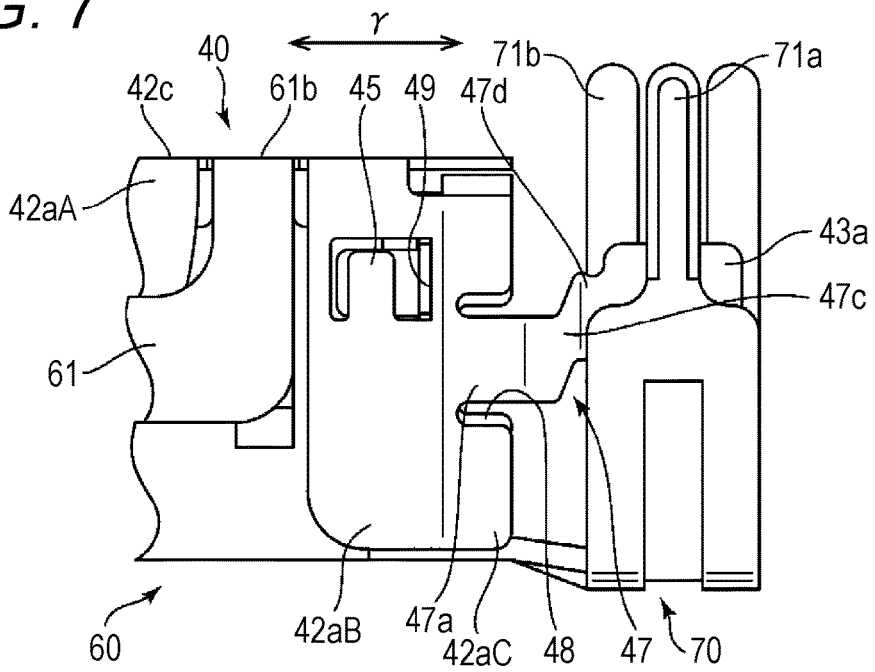
FIG. 7 is a side view illustrating the state in which the first shell and the second shell are assembled together.
Figure 8:
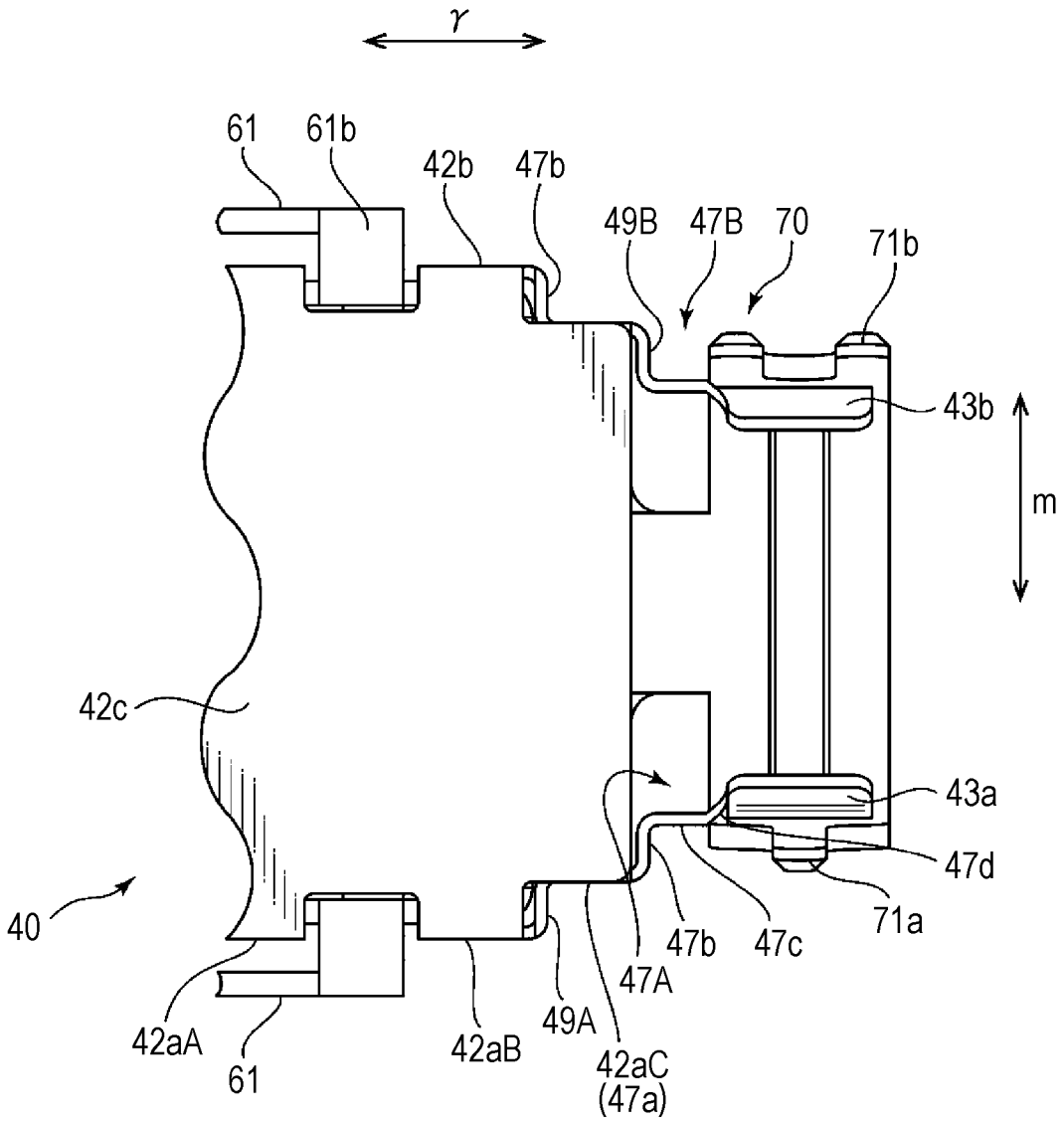
FIG. 8 is a plan view illustrating the state in which the first shell and the second shell are assembled together.

FIG. 3 is a schematic back view of jigs for swaging the swaging portion 71 together with peripheral members of the swaging portion 71 and the sandwiching portions 43, FIG. 4 is a partial enlarged view of the back of the second shell 40, and FIG. 5 is a partial enlarged perspective view of the back of the first shell 60. FIGS. 6 to 8 illustrate a state in which the first shell 60 and the second shell 40 are assembled together, and more specifically, each illustrate a partial enlarged perspective view, a side view, and a plan view of a state right before swaging of the swaging portion 71.

As illustrated in FIG. 3, the jigs include, for example, a jig 7*a* configured to support a bottom side of the cable receiving portion 73 and a jig 7*b* to be pressed against the swaging pieces 71*a*, 71*b* of the swaging portion 71 from above. The jig 7*b* has an arc-shaped inner wall 7*c* in accordance with the outer surface shape of the cable 4.

Upon swaging of the swaging portion 71, the sandwiching portions 43*a*, 43*b* are sandwiched between the swaging portion 71 and the cable 4. As a result, the first shell 60 and the second shell 40 can be firmly connected to each other, and can be electrically connected to each other through conductive contact among the swaging portion 71 and the sandwiching portions 43*a*, 43*b*.

Moreover, upon swaging of the swaging portion 71, the external conductor (the braid) 4*b* of the cable 4 is taken out of the cable 4, and is placed along the outer cover 4*a* of the cable 4. As a result, the second shell 40 can be electrically connected through the sandwiching portions 43 and the external conductor 4*b*, and the first shell 60 can be also electrically connected to the external conductor 4*b* through connection between the first shell 60 and the second shell 40. That is, the external conductor 4*b*, the first shell 60, and the second shell 40 are electrically connected to each other.

The pair of sandwiching portions 43*a*, 43*b* is supported in a cantilever shape from the main body 42 of the second shell 40 toward the swaging portion 71 of the first shell 60. The sandwiching portions 43*a*, 43*b* may be each connected to the side walls 42*a* (42*a*A to 42*a*C), 42*b* (42*b*A to 42*b*C) forming the main body 42 through extra length portions 47A, 47B, for example.

The extra length portions 47A, 47B are extendable at least in the axial direction "γ" of the cable 4. For example, as illustrated in the figure, an accordion-shaped bent portion may be provided. The bent portion can be easily manufactured at low cost by bending of a metal plate. The bent portion at least includes portions 47*a*, 47*c* extending in the axial direction "γ" and a portion 47*b* extending in the radial direction (the direction of an arrow "m" as illustrated in FIGS. 1, 3, 8 and the like) of the cable 4. Note that as long as the bent portion includes the portions extending in the axial direction "γ" and the portion extending in the radial direction "m" of the cable 4, these portions are not necessarily separately provided. For example, it is enough to include a portion extending in the axial direction "γ" and extending in the radial direction "m" of the cable 4. With these portions, the length of the extra length portion 47 can be longer than that in the case of extending straight toward the swaging portion 71. That is, the extra length portion is extendable.

The extra length portion 47 preferably further includes a portion 47*d* extending in the circumferential direction "K" of the cable 4. With the portion 47*d* extending in the circumferential direction, an extension direction of the extra length portion 47 can be more matched to the shape of the cable 4. Note that as long as the bent portion includes the portion extending in the circumferential direction "K" of the cable 4, the portions are not necessarily separately provided. For example, the bent portion may include a portion extending in the axial direction "γ," extending in the radial direction "m" of the cable 4, and extending in the circumferential direction "K" of the cable 4. Alternatively, the bent portion may include only a portion extending in the axial direction "γ" and extending in the radial direction "m" of the cable 4 and a portion extending in the circumferential direction "K" of the cable 4. In addition, various combinations can be employed.

For placing the sandwiching portions 43*a*, 43*b* close to the swaging portion 71 without increasing the lengths of the extra length portions 47A, 47B, step portions 49 (49A, 49B) may be each provided at the side walls 42*a*, 42*b*. For example, the step portion 49A may be provided between the side wall portion 42*a*B and the side wall portion 42*a*C of the side wall 42*a*, and the step portion 49B may be provided between the side wall portion 42*b*B and the side wall portion 42*b*C of the side wall 42*b*. With the step portions 49, a width between the side wall 42*a* and the side wall 42*b* facing each other can be narrowed, and the extra length portions 47A, 47B can be placed close to the swaging portion 71.

Alternatively, slits 48 may be provided for the side wall portions 42*a*C, 42*b*C in the vicinity of base portions 47*a* of the extra length portions 47A, 47B. With the slits, the extra length portions 47A, 47B can be more smoothly extended.

Upon swaging of the swaging portion 71, the sandwiching portions 43 are sandwiched between the swaging portion 71 and the cable 4, and are swaged together with the cable 4 and the like by the swaging portion 71. As a result, there is a probability that the main body 42 of the second shell 40 receives tensile force in the γ-direction through the sandwiching portions 43. In the case of great tensile force or a long tensile distance, deformation of the side walls 42*a*, 42*b* of the second shell 40 might be caused, and in the worst case, might be damaged. With the crank-shaped extra length portions 47 and the step portions 49, such a risk can be reduced. According to the present configuration, in the case of pulling the sandwiching portions 43*a*, 43*b*, the extra length portions 47A, 47B are extended without pulling of the main body 42 itself, and therefore, deformation and damage of the second shell 40 can be effectively prevented.

In the case of extending the extra length portions 47A, 47B as described above, there is a probability that the extra length portions 47A, 47B collide, in the vicinity of the base portions 47*a* of the extra length portions 47A, 47B at the main body 42, with the side walls 62*a* of the main body 62 of the first shell 60 positioned inside the extra length portions 47A, 47B and deform the first shell 60. Moreover, there is a probability that extension of the extra length portions 47A, 47B is interfered due to collision of 47*a* of the extra length portions 47A, 47B with the side walls 62*a* of the main body 62. For preventing these situations, cutouts 64 are, at positions closer to the swaging portion 71 than the base portion 47*a* is to, preferably provided in the vicinity of the base portions 47*a* at the side walls 62*a* of the first shell 60. With the cutouts 64, collision among the extra length portions 47A, 47B and the first shell 60 can be effectively prevented.

Upon swaging of the sandwiching portions 43*a*, 43*b* by the swaging portion 71, at least a portion of the sandwiching portion 43*a*, 43*b* is, in the circumferential direction "K," preferably arranged closer to the swaging portion 71 with respect to a boundary 73*d* between the cable receiving portion 73 and the swaging portion 71. In this case, at least the portions of the sandwiching portions 43*a*, 43*b* are directly swaged by the swaging portion 71, and therefore, the first shell and the second shell can be more firmly connected to each other through contact among the sandwiching portions 43*a*, 43*b* and the swaging portion 71 and physical and electrical connection between these shells can be reliably made.

Moreover, when the sandwiching portions 43*a*, 43*b* are swaged by the swaging portion 71, at least portions of the sandwiching portions 43*a*, 43*b* are preferably swaged at a portion other than a portion 74 (see FIG. 1) at which two swaging pieces 71*a*, 71*b* engage with each other. This is because tendency generally shows that swaging force is weaker at the portion at which the swaging pieces 71*a*, 71*b* engage with each other.

The number of sandwiching portions 43*a*, 43*b* is not specifically limited, but at least two sandwiching portions are preferably provided. As clearly illustrated in FIGS. 3 and 6, these two sandwiching portions 43*a*, 43*b* are, in the section "α-β" of the cable 4 in the radial direction, arranged substantially bilaterally symmetrically about the cable receiving portion 73. Thus, when the swaging portion 71 is swaged to the cable 4, even if the main body 42 receives the tensile force through the sandwiching portions 43, the tensile force can be equally dispersed to the right and left. Moreover, since the sandwiching portions 43*a*, 43*b* are arranged substantially bilaterally symmetrically, a favorable electrical flow of the external conductor 4*b* and the shells 60, 40 through the sandwiching portions 43*a*, 43*b* can be realized and electrical characteristics can be improved.

It should be understood that description above relates to the preferred embodiment and merely represents a product. It can be recognized that variations and corrections of different embodiments are easily apparent to those skilled in the art according to the above-described teaching. Thus, exemplary embodiments and representative embodiments can be implemented without departing from the spirit of a product and a method described in the attached claims.

LIST OF REFERENCE NUMERALS

4 cable
11A cover
11B cover
20 housing
21 main body portion
30 terminal holding portion
40 second shell
42 main body
43 sandwiching portion
47 extra length portion
47*a* base portion
46 cutout
60 first shell
62 main body
70 cable fixing portion
71 swaging portion
71*a* swaging piece
71*b* swaging piece

The invention claimed is:

1. A cable connector comprising:
a housing configured to hold one end of a cable;
a first shell including a main body covering at least a portion of the housing; and
a second shell including a main body covering at least a portion of the housing,
wherein the first shell has, at a position apart from the main body of the first shell in an axial direction of the cable, a swaging portion to be swaged to the cable,
the second shell has, at a position apart from the main body of the second shell in the axial direction of the cable, a sandwiching portion to be swaged together with the cable by the swaging portion with the sandwiching portion being sandwiched between the swaging portion and the cable,
the sandwiching portion and the main body of the second shell are connected to each other through an extra length portion which is extendable at least in the axial direction, and
in a case of pulling the sandwiching portion in the axial direction, the extra length portion is extended in the axial direction.

2. The cable connector according to claim 1, wherein
the sandwiching portion is supported in a cantilever shape from the main body of the second shell toward the swaging portion of the first shell.

3. The cable connector according to claim 2, wherein
the extra length portion has a bent portion, and the bent portion at least includes a portion extending in the axial direction and a portion extending in a radial direction of the cable.

4. The cable connector according to claim 3, wherein
the bent portion further includes a portion extending in a circumferential direction of the cable.

5. The cable connector according to claim 1, wherein
the main body of the second shell has a pair of side walls arranged to face each other,
the sandwiching portion is connected to each of the pair of side walls through the extra length portion.

6. The cable connector according to claim 5, wherein
a step portion for narrowing a width between the pair of side walls facing each other is provided at each side wall.

7. The cable connector according to claim 5, wherein
a slit is provided in a vicinity of a base portion of the extra length portion at each side wall.

8. The cable connector according to claim 1, wherein
the swaging portion is, in a circumferential direction of the cable, provided continuously to an inner surface of a cable receiving portion on which the cable is to be mounted, and
at least a portion of the sandwiching portion is, in the circumferential direction, arranged closer to the swaging portion with respect to a boundary between the cable receiving portion and the swaging portion.

9. The cable connector according to claim 8, wherein
a side wall of the main body of the first shell is positioned closer to the swaging portion than a base portion of the extra length portion of the main body of the second shell is to in a vicinity of the base portion of the extra length portion of the main body of the second shell, and
a cutout for avoiding collision with the extra length portion is provided near the base portion at the side wall.

10. The cable connector according to claim 8, wherein
the swaging portion has two swaging pieces each extending from both ends of the cable receiving portion in the circumferential direction, and
at least a portion of the sandwiching portion is swaged by the swaging portion at a portion other than a portion at which the two swaging pieces engage with each other.

11. The cable connector according to claim 10, wherein
the sandwiching portion includes at least two sandwiching portions, and the sandwiching portions are arranged substantially bilaterally symmetrically about the cable receiving portion in a section of the cable in the radial direction.

12. A cable connector comprising:
a housing configured to hold one end of a cable;
a first shell including a main body covering at least a portion of the housing; and
a second shell including a main body covering at least a portion of the housing,
wherein the first shell has, at a position apart from the main body of the first shell in an axial direction of the cable, a swaging portion to be swaged to the cable,
the second shell has, at a position apart from the main body of the second shell in the axial direction of the cable, a sandwiching portion to be swaged together with the cable by the swaging portion with the sandwiching portion being sandwiched between the swaging portion and the cable, the sandwiching portion and the main body of the second shell are connected to each other through an extendable extra length portion at least in the axial direction, the sandwiching portion is supported in a cantilever shape from the main body of the second shell toward the swaging portion of the first shell, and the extra length portion has a bent portion, and the bent portion at least includes a portion extending in the axial direction and a portion extending in a radial direction of the cable.

13. The cable connector according to claim 12, wherein the bent portion further includes a portion extending in a circumferential direction of the cable.

* * * * *